US005446958A

United States Patent [19]

Hoang

[11] Patent Number: 5,446,958

[45] Date of Patent: Sep. 5, 1995

[54] METHOD OF JOINING A BOBBIN AND LEAD-OUT TERMINAL IN A SMALL TRANSFORMER

[75] Inventor: M. S. Hoang, Wu Ku Taipei Hsien, Taiwan

[73] Assignee: Bobbin & Base Industrial Co., Wu Ku Taipei, Taiwan

[21] Appl. No.: 134,423

[22] Filed: Oct. 8, 1993

[51] Int. Cl.[6] ..... H01F 41/02

[52] U.S. Cl. ..... 29/605; 29/564.6; 29/882; 336/192

[58] Field of Search ..... 29/605, 882, 602.1, 29/842, 844, 845, 564.6; 336/192

[56] References Cited

U.S. PATENT DOCUMENTS 4,354,310 10/1982 Hatton ..... 29/605

*Primary Examiner*—Carl E. Hall

*Attorney, Agent, or Firm*—Pro-Techtor International

[57] ABSTRACT

A method of joining a bobbin and lead-out terminal in small transformers employed in the electronic industry, which is characterized by the fact that the lead-out terminals can be mounted onto a bobbin by an insertion means, that the terminal can be mounted securely onto the bobbin lead-out manifold using bending devices, and that the mounting operation can be performed automatically in a high-speed manner and various terminal configurations can be achieved.

1 Claim, 4 Drawing Sheets

METHOD OF JOINING A BOBBIN AND LEAD-OUT TERMINAL IN A SMALL TRANSFORMER

Description of the Invention

Conventional methods for mounting a bobbin lead-out terminal in a small transformer involve fixing said lead-out terminal by molding, which is subject to drawbacks, as will be described below. The principal objective of the present invention is to present a method for mounting a bobbin lead-out terminal in a small transformer, with which said mounting operation can be performed automatically in a high-speed manner and various terminal configurations can be achieved in accordance with the applications.

FIG. 1 depicts a conventional configuration of a bobbin with a coil lead-out stub H joining with a terminal P in a small transformer. The insertion of said terminal P into said small transformer requires several steps. Specifically, said terminal P is fabricated into the desirable shape, the terminal P obtained is placed into the injection mold cavity for fabricating said bobbin, and said terminal P is implanted into said bobbin by molding after the injection of a plastic material into said mold cavity. However, said method of mounting a bobbin lead-out terminal is undesirable in that the insertion of said lead-out terminal interferes with the injection molding operation and the technique is cumbersome because the lead-out terminal part is quite small. Accordingly, said method is inefficient. Moreover, the main body of said bobbin lead-out stub is fabricated into a certain shape for accommodating the configuration of said lead-out terminal (see FIGS. 2 and 3), thereby requiring different molds for different configurations, which is not costeffective. The present invention presents a method for mounting a bobbin lead-out terminal in a small transformer by inserting said terminal into a lead-out manifold, with which various lead-out manifold configurations can be employed, production efficiency can be increased appreciably, various lead-out terminal configurations can be used, depending on the applications, and the number of dies needed is reduced, thereby lowering operation costs.

A description including figures is presented below for explaining the technical means employed for achieving the aforesaid merits and objectives pertaining to the present invention.

DESCRIPTION OF THE FIGURES

The present invention offers a method for mounting a terminal 3 into a bobbin lead-out wire-stab manifold 2 of a small transformer bobbin 1, as shown in FIG. 4. Said bobbin 1 is fabricated by injection molding, and the bobbin body 11 is to be wrapped with an enamelinsulated wire. The two ends of said bobbin body 11 are each equipped with a manifold 2 possessing a series of wire slots 21 and insertion holes 22 aligned in an orderly manner, with said manifold 2 being positioned vertically with respect to said bobbin body 11. As shown in FIG. 5, said manifold 2 is equipped with a series of wire slots 21 for accommodating the bobbin lead-out wire stabs, and said wire slot 21 runs in the length direction of said bobbin body 11. Said wire slot 21 possesses an opening that faces toward a corresponding circuit board 4, so that the mounting surface 12 is equipped with H-shaped tunnel-like openings for accommodating the bobbin lead-out wire stab 5 from said bobbin 11. Said lead-out wire stab 5 coming out from said wire slot 21 is to be soldered onto a terminal. In addition, said bobbin lead-out wire-stab manifold 2, which is made of a solid piece of plastic, is equipped with insertion holes 22 that run along the length direction thereof in the middle of said mounting surface 12. Said insertion hole 22 for accommodating said terminal 3 is positioned vertically with respect to said mounting surface 12. Said manifold 2 is also equipped with a mounting surface 23 for said terminal 3 to be mounted, which requires a bending operation. Said mounting surface 23 is positioned at a location that corresponds to said insertion hole 22, and faces away from said bobbin body 11 in a parallel direction. With the aforesaid configuration, said terminal 3 is bound upon being inserted into said insertion hole 22. The binding strength depends on factors such as the degree of fitness between said insertion hole 22 and terminal 3 and the characteristics of the plastic material used for fabricating said manifold 2 (e.g., compressibility, tear resistance, etc.).

Figure 6:
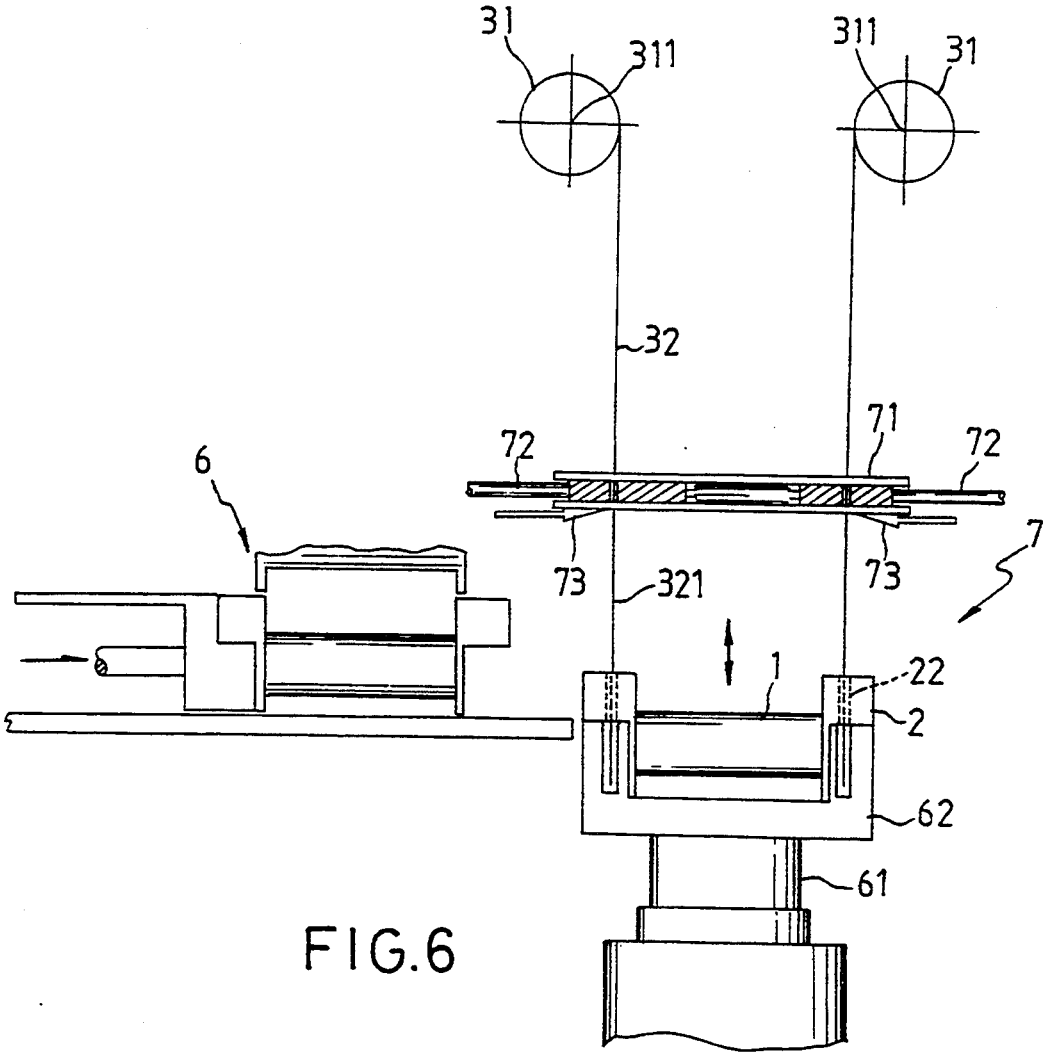
FIG. 6: A drawing showing the operation of the mechanism employed for inserting lead-out terminals pertaining to the present invention.

The method of inserting said terminal 3 into said bobbin 1 is described below together with FIG. 6. A sending device 6 is employed to send said bobbin 1, which is obtained by injection molding, into the loading platform 62 of a piston stroke device 61. Said loading platform 62 is designed to house said bobbin 1. A set of terminal-wire rolls 31 is placed above the piston-stroke movement line of said piston stroke device 61. Each of said terminal-wire rolls 31 is aligned with the center of said insertion hole 22 and placed on a turnable axle 311. A cutting device 7 is placed near the bobbin lead-out wire-stab manifold 2 between said wire roll 31 and bobbin 1. Said cutting device 7 consists of a platform bed 71, sliding press plate 72 and cutter 73. Said sliding press plate 72 can slide along said platform bed 71, and a gap in said sliding press plate 72 allows said the terminal wire 32 to be inserted through. According to the movements of the aforesaid mechanisms, said terminal wire 32 is inserted through said cutting device 7 until the terminal-wire stub 321 is near said insertion hole 22, and the terminal-wire stub 321 is held in place, aligning with the center of said insertion hole 22. Next, said piston stroke device 61 lifts said bobbin 1 to a position, so that said terminal wire 32 can be inserted into the insertion hole 22. Afterward, the terminal wire is cut to an appropriate length.

Figure 1:
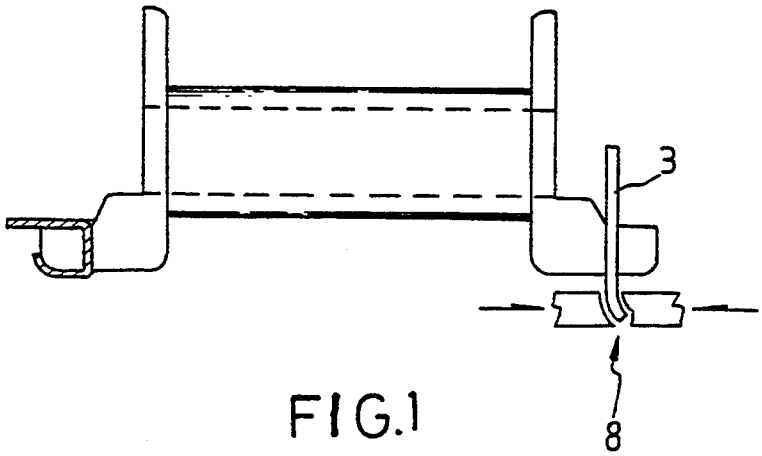
FIG. 1: A conventional means of mounting a bobbin lead-out terminal.
Figure 2:
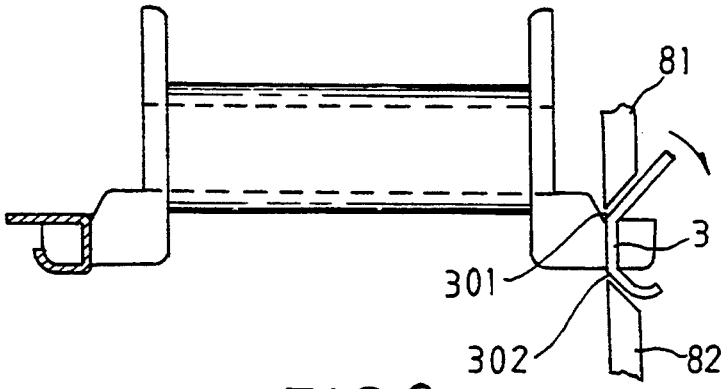
FIGS. 2 and 3: Practical examples pertaining to the present invention.
Figure 7:
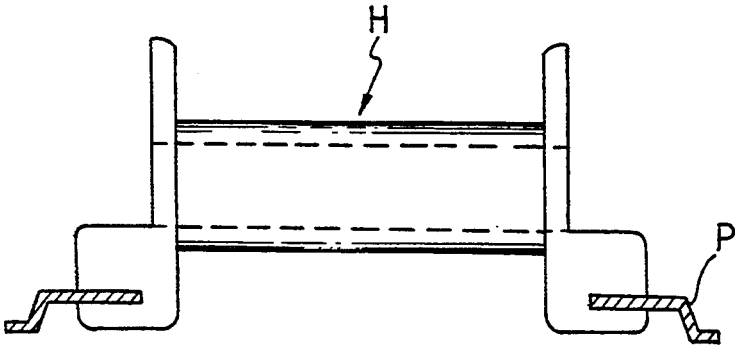
FIGS. 7, 8 and 9: Drawings showing the process of bending the lead-out terminal.
Figure 8:
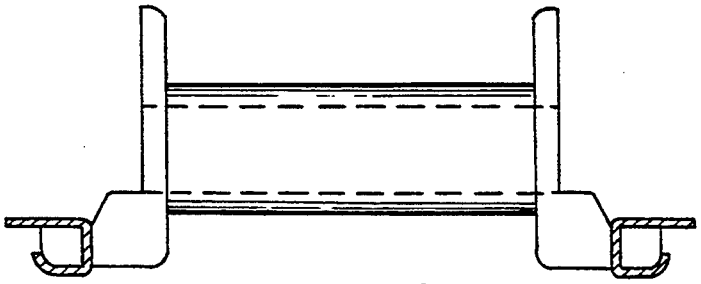
Figure 9:
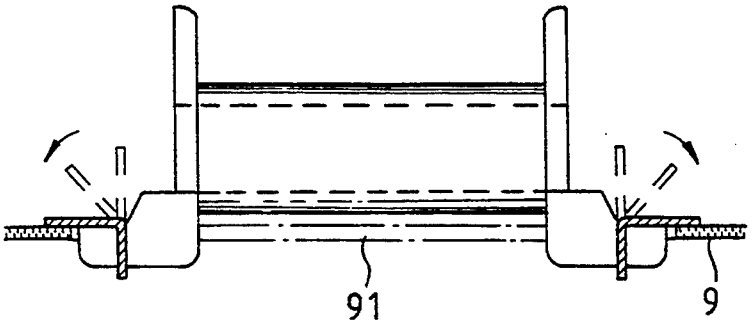

The operation steps of bending the resulting terminal 3 are described below together with FIGS. 7, 8 and 9. These figures concern a practical example of a terminal configuration shown in FIG. 2. The bending operation is performed by a machine. A set of dies 8 is employed to bend one end of said terminal 3 held by said manifold 2. Both the male and female dies 8 are equipped with curved edges, so that a curved terminal 3 is obtained.

Next, a preliminary bending operation is performed, so that a more precise bending angle can be achieved in subsequent bending operations. As shown in FIG. 8, a set of stamping devices 81 and 82 each with a tilted surface is employed to cause the bases 301 and 302 of the two ends of said terminal 3 held by said manifold 2 to be bent at a 45° angle. The final bending operation is depicted in FIG. 9. A set of stamping devices 83 and 84 each with a fiat surface is employed to cause said terminal 3 to wrap around said manifold 2 securely. Since the terminals are positioned in an orderly manner and each bending step involves the employment of an appropriate set of stamping dies, the shape and dimensions of the resulting terminals after bending are uniform and orderly, facilitating the installation of the resulting transformer onto a circuit board evenly by soldering.

Figure 3:
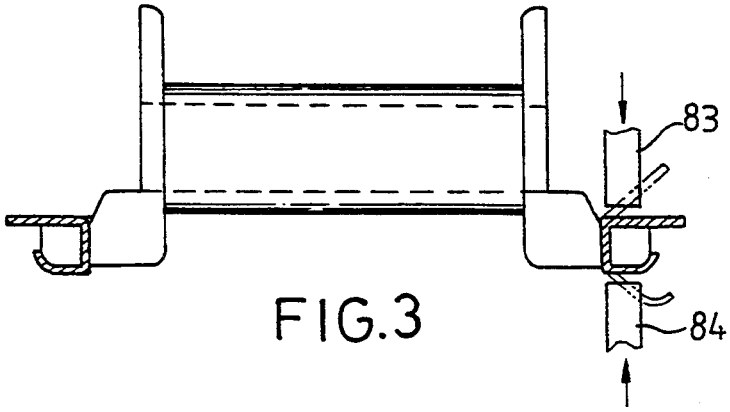
Figure 4:
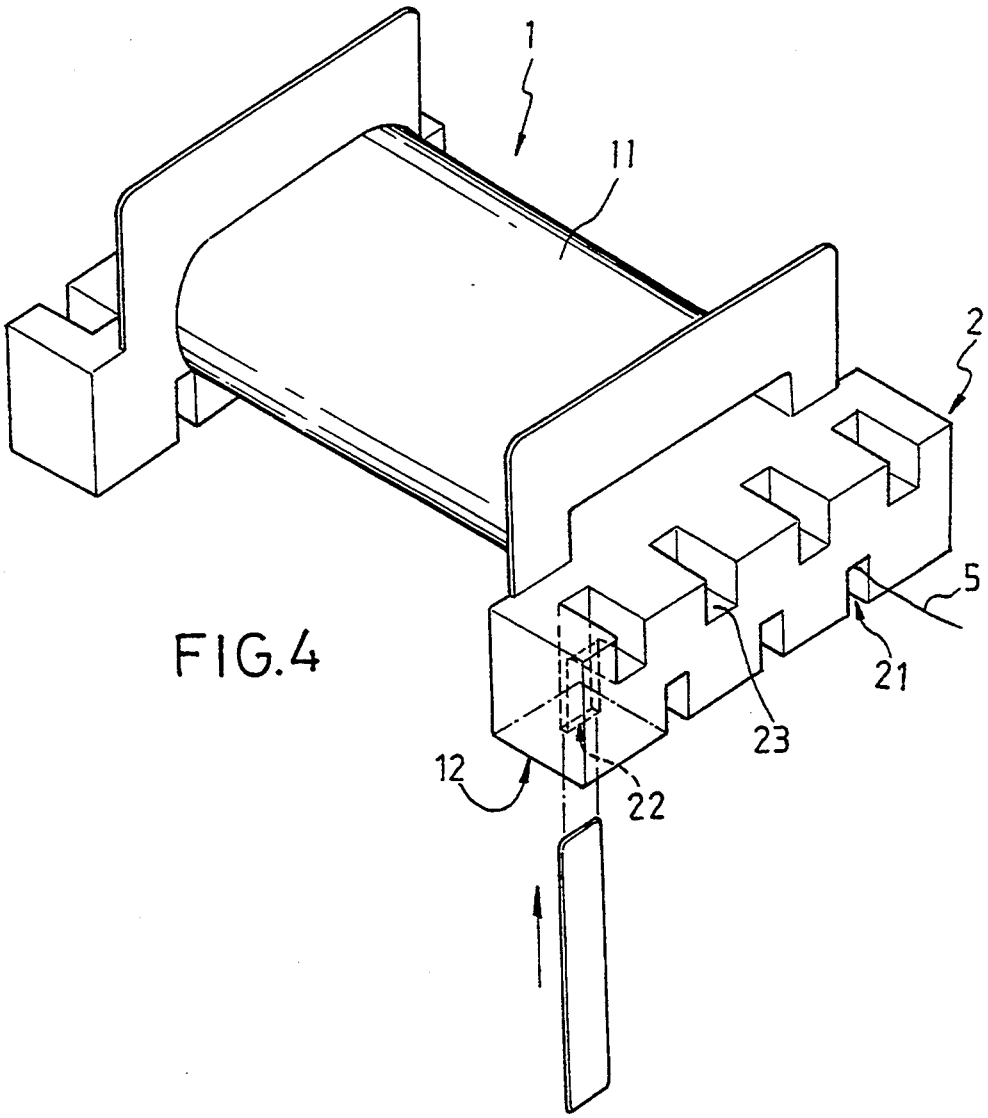
FIG. 4: A three-dimensional drawing showing a bobbin fabricated in accordance with the present invention.
Figure 5:
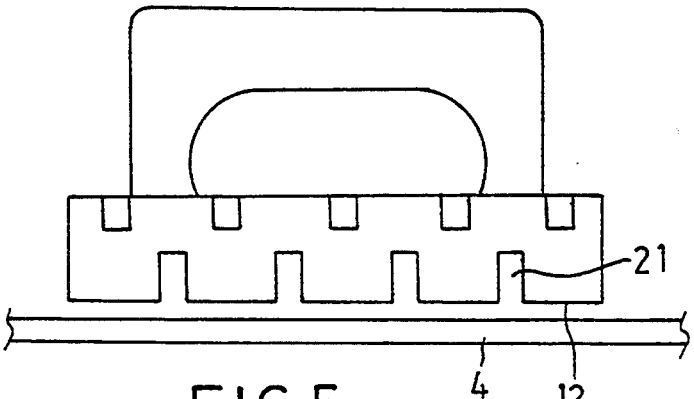
FIG. 5: A side view of the bobbin fabricated in accordance with the present invention.

If demanded by the design of a circuit board, the bobbin body can also be placed into a cavity 91 in a circuit board 9 for reducing the height of said bobbin. In this configuration, the terminal 3 is bent into an "L" shape, as shown in FIG. 3. In summary, the terminals can be formed into various shapes by using different stamping dies and techniques. The emphasis of the present invention is to offer a method for mounting a bobbin lead-out terminal in a small transformer that involves a set of lead-out wire-stub manifolds equipped with insertion holes into which terminals can be inserted in a mass production manner, with which various lead-out manifold configurations can be employed, production efficiency can be increased appreciably, various lead-out terminal configurations can be used, depending on the applications, and the number of dies needed is reduced, thereby lowering operation costs.

The objective of the present invention of presenting a method of mounting terminals into the manifold of a bobbin by insertion is to solve the problems associated with conventional means of mounting lead-out terminals by molding. An injection mold and several stamping dies are employed in accordance with the method pertaining to the present invention, with which the mounting operation can be performed automatically at a high-speed manner, various terminal configurations can be achieved, and the shape and dimensions of the resulting terminals after bending are uniform and orderly, facilitating the installation of the resulting transformer onto a circuit board evenly by soldering.

I claim:

1. A method of manufacturing transformers comprising:

(A) injection molding a bobbin so as to include at each of two ends thereof a manifold comprising a plurality of lead-out wire accommodation slots, and a corresponding plurality of terminal insertion holes, (B) inserting terminal wire from a plurality of terminal wire rolls into a selected number of terminal insertion holes, (C) cutting said terminal wire to a desired length, (D) bending an anchoring end of said terminal wire to a shape to conform to that of a lower, outer edge of the manifold with a first set of bending dies, (E) bending both ends of the terminal wire to a 45° angle with a second set of bending dies, and (F) employing a third set of bending dies which bend the anchoring end of the terminal wire so as to wrap around the manifold, thereby anchoring the terminal wire, while simultaneously bending the free end of the terminal wire to a desired position.

* * * * *